US006565498B2

(12) United States Patent
Nakada et al.

(10) Patent No.: US 6,565,498 B2
(45) Date of Patent: May 20, 2003

(54) COMPOSITE ROLL FOR MANUFACTURING HEAT TRANSFER TUBES

(75) Inventors: Isao Nakada, Tokyo (JP); Takao Kobayashi, Tokyo (JP)

(73) Assignee: Fuji Die Co., Ltd., Tokyo (JP)

( * ) Notice: Subject to any disclaimer, the term of this patent is extended or adjusted under 35 U.S.C. 154(b) by 0 days.

(21) Appl. No.: 09/848,593

(22) Filed: May 3, 2001

(65) Prior Publication Data

US 2001/0042588 A1 Nov. 22, 2001

(30) Foreign Application Priority Data

May 10, 2000 (JP) ..... 2000-136599

(51) Int. Cl.[7] ..... B23P 15/00

(52) U.S. Cl. ..... 492/30; 492/31; 492/33; 492/34; 492/35; 492/36; 492/38; 492/39

(58) Field of Search ..... 72/199; 492/30, 492/31, 33–36, 38, 39, 54, 58; 493/471; 29/727

(56) References Cited

U.S. PATENT DOCUMENTS 4,650,454 A * 3/1987 Moll ..... 118/221
4,765,058 A * 8/1988 Zohler ..... 29/727
5,129,876 A * 7/1992 Brabant et al. ..... 492/30
5,234,040 A * 8/1993 Koba ..... 100/121
5,267,008 A * 11/1993 Rebres et al. ..... 271/119
5,463,889 A * 11/1995 Snyder et al. ..... 492/39
5,477,912 A * 12/1995 Cisko et al. ..... 164/432
5,483,811 A * 1/1996 Miller ..... 492/39
5,529,100 A * 6/1996 Koba ..... 100/121
5,761,807 A * 6/1998 Schuez et al. ..... 29/727
2001/0041652 A1 * 11/2001 Tsukada et al. ..... 492/30

* cited by examiner

*Primary Examiner*—I Cuda Rosenbaum
(74) *Attorney, Agent, or Firm*—Jordan and Hamburg LLP

(57) ABSTRACT

In a composite roll for manufacturing heat transfer tubes that has two or more grooving rolls having protrusions where at least one of cross sectional shapes, lead angles relative to a rotation direction and sizes is different, by coaxially combining the rolls to form multiple types of grooves on a surface of metallic strips by pressing against the metallic strips, the composite roll for manufacturing heat transfer tubes of the present invention is characterized in that the two or more grooving rolls are joined in one body in a mutually surface contacting state. It is also preferable that the two or more grooving rolls are joined by diffusion bonding.

3 Claims, 2 Drawing Sheets

COMPOSITE ROLL FOR MANUFACTURING HEAT TRANSFER TUBES

TECHNICAL FIELD

The present invention relates to a composite roll for manufacturing metallic strips for use in manufacturing heat transfer tubes internally formed with multiple types of grooves, and the method of manufacturing the composite roll.

BACKGROUND ART

For heat exchangers of refrigerators, air conditioners, and so on, heat transfer tubes formed internally with a number of grooves are used to obtain heat transfer efficiency. Since an apparatus having high performance and compact size has recently been desired, there has been an attempt to improve the heat transfer tubes with internal grooves. As the techniques thereof, examined has been the application of heat transfer tubes formed with internal grooves, including a number of single shape grooves and multiple types of grooves in which at least one of cross sectional shapes, lead angles, and sizes is different.

A method of manufacturing the heat transfer tube with grooves includes an art described in Japanese Patent Application Publication Laid-open No. Hei 4-15819. In this method, three or more rolls having protrusions in which at least one of cross sectional shapes, lead angles relative to a rotation direction and sizes is different, are coaxially combined as a roll for use. By sandwiching a smooth metallic strip between the combined roll and a smooth roll, grooves are formed on a surface of the metallic strip. Subsequently, the metallic strip is wound in a tube shape with the processed surface as an inner surface, and is butt welded, to a heat transfer tube with grooves.

The roll in use herein is fixed by tightening the three or more rolls in a removable manner. According to this art, multiple types of grooves may be simultaneously formed on metallic strips, so that the productivity of heat transfer tubes becomes preferable and advanced heat transfer tubes can be manufactured.

However, in repeatedly processing metallic strips by the combined roll, metallic strips with grooves may have preferable quality at the beginning of processing, but groove shapes sometimes deteriorate as the processing quantity increases. Particularly, surfaces that are processed with grooves around a boundary between different rolls in contact with each other sometimes have isolated or deformed grooves due to insufficient processing. In other words, the composite roll for use in the conventional method has poor durability and needs to be exchanged at high frequency, so that the roll is not suitable for mass production and the increase in production costs is a concern.

The present invention was made under the above-noted background. The object thereof is to provide a composite roll which has excellent durability and can process over a long period with stability, in composite rolls for forming multiple types of grooves on metallic strips. It is also an object to provide a method of manufacturing the composite roll of preferable durability with certainty.

DISCLOSURE OF INVENTION

When the present inventors examined the surface of the conventional combined roll during use, they found that a processing material enters extremely minute gaps at contacting parts of each roll in the conventional roll due to repeated use. At the same time, it was found that the entered processing material widens the gaps due to contact between the roll and metallic strips, resulting to the deformation or fracture of protrusions around the contacting parts. According to the results, the present inventors have reached the conclusion that joining faces should have no gaps so as to improve the durability of a composite roll, and have come up with the present invention.

Specifically, in a composite roll for manufacturing heat transfer tubes which has two or more grooving rolls having protrusions where at least one of cross sectional shapes, lead angles relative to a rotation direction and sizes is different, by coaxially combining the rolls to form multiple types of grooves on a surface of metallic strips by pressing against the metallic strips, the composite roll for manufacturing heat transfer tubes of the present invention is characterized in that the two or more grooving rolls are joined in one body in a mutually surface contacting state.

To "join" in the description above herein indicates a joined state by a chemical or material scientific joining method such as welding and brazing. It is a state in which a material is physically combined in one body without discontinuous interfaces such as gaps. This state is distinguished from the state of the conventional combined roll which is joined in one body by tightening, in other words, mechanical joining.

The composite roll relating to the present invention has no gaps to which a processing material enters, and is physically in one body, so that protrusions are not deformed during use. Accordingly, the composite roll has excellent durability, and can process metallic strips continuously over a long period.

Moreover, in joining the grooving rolls to each other, they may be joined by brazing as described above. However, joining strength by brazing is low even though an appropriate brazing material is selected in consideration of a roll material. Thus, it is preferable that the two or more grooving rolls are joined by diffusion bonding. The diffusion bonding joins a material by atomic diffusion between contacting faces. Since an intermediate material such as a brazing material in brazing is not used in the diffusion bonding, joining parts are uniform in a material microstructure. Additionally, joining strength is more preferable than the strength from brazing. Moreover, the roll material is joined without being molten as in welding, so that the grooving rolls may be joined in one body without deforming the protrusions of the rolls before joining.

As a material for a roll continuously pressing metallic strips as in the present invention, it is preferable to use tungsten carbide-based cemented carbide having hardness of 81 to 90 in the Rockwell A hardness (referred to as "HRA", hereafter). General tool steel is also applicable, but cemented carbide is hard and can maintain the durability of rolls. The tungsten carbide-based cemented carbide herein is an alloy in which tungsten carbide (WC) powder is sintered with iron, cobalt or nickel as a binder. The tungsten carbide-based cemented carbide also includes an alloy to which carbides are added such as titanium carbide (TiC), tantalum carbide (TaC), molybdenum carbide ($Mo_2C$), vanadium carbide (VC) and chromium carbide ($Cr_3C_2$), besides tungsten carbide. The use of a cemented carbide having hardness of 81 to 90 in HRA is considered preferable because a cemented carbide having less than 81 hardness has insufficient wear resistance. On the other hand, a cemented carbide having more than 90 hardness has sufficient wear resistance, but has less toughness so that the protrusions are likely to be fractured as a roll.

Furthermore, although the tungsten carbide-based cemented carbide in which tungsten carbide is sintered with cobalt as a binder is generally used, it is preferable to apply tungsten carbide-nickel cemented carbide in which nickel is used as a binder in consideration of corrosion resistance. In processing metallic strips, lubricant or processing liquid is sometimes poured between the roll and a processing material in order to prevent the roll and the processing material from sticking and to improve productivity. However, the processing liquid is corrosive. Additionally, in case of applying the tungsten carbide-nickel cemented carbide, it is also preferable to use an alloy having hardness of 81 to 90 in HRA for the same reasons as mentioned above.

Subsequently, a method of manufacturing the roll relating to the present invention will be explained. As previously described, in the present invention, two or more grooving rolls are integrally joined by diffusion bonding. As the method thereof, after the two or more grooving rolls having protrusions where at least one of cross sectional shapes, lead angles relative to a rotation direction and sizes is different, are coaxially combined, the combined grooving rolls are joined by pressing and heating simultaneously.

As the condition thereof, it is preferable to join the grooving rolls by pressing at the heating temperature of lower than a melting point of a binder of the cemented carbide as a component of the rolls, and with the pressure of 1.0 to 5.0 MPa for two to seven hours under a non-oxidizing atmosphere. The heating temperature is limited since the cemented carbide is partially softened or melted when the temperature is at the same or higher than the melting point of a binder of the cemented carbide as a component of the rolls. Accordingly, the grooving rolls are deformed in a joining step, and a composite roll of preferable precision cannot be manufactured. Moreover, the heat holding time is two to seven hours so as to join the rolls with certainty even at relatively low temperature by continuously pressing them over a long period. Additionally, the rolls are joined under a non-oxidizing atmosphere so as to prevent the oxidation of contacting faces of the grooving rolls and to accelerate joining.

Furthermore, in performing diffusion bonding under such conditions, it is preferable to grind joining faces before combining the grooving rolls. Since actual joining faces have oxide film that prevents atomic diffusion, the film has to be removed. Additionally, by flattening the joining faces, an actual contacting area is increased so that joining may be more smoothly performed. It is also preferable that the joining faces have the flatness of less than 5 $\mu$m in grinding the joining faces.

MODE FOR CARRYING OUT THE INVENTION

The examples of the present invention are explained below along with the drawings.

FIRST EXAMPLE

Figure 1:
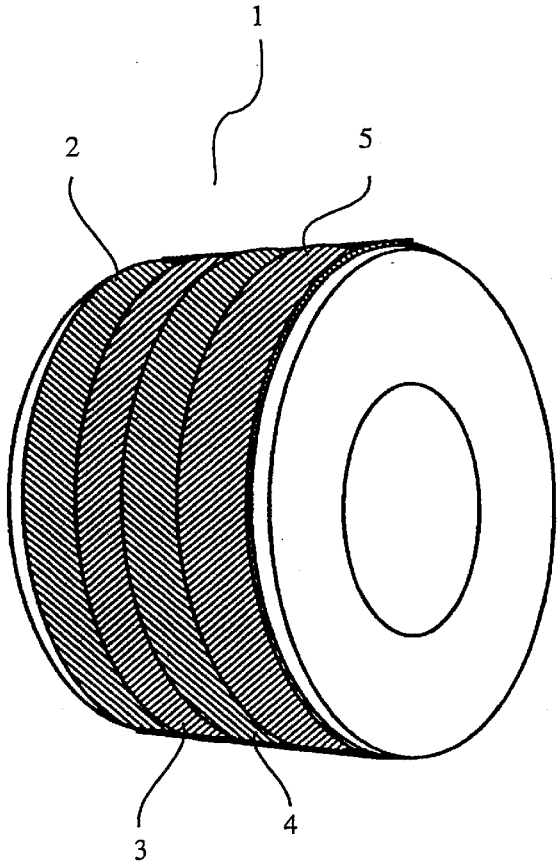
FIG. 1 is a schematic view of a composite roll manufactured in a first example.

FIG. 1 is a schematic appearance of a composite roll 1 relating to the example of the present invention. In FIG. 1, the composite roll 1 is made by coaxially joining each grooving roll 2 to 5 having 4 types of protrusions (0.26 mm in height; 0.41 mm in protrusion pitch) that are different only in directions. These grooving rolls are joined in one body by diffusion bonding in a step that will be later described. Moreover, the grooving rolls are made of tungsten carbide-based cemented carbide (WC-22% Co, WC mean grain size of 2.5 $\mu$m: hardness HRA of 84.5).

As the method of manufacturing the composite roll 1, after the grooving rolls 2 to 5 were formed with desirable protrusions by grinding and polishing with a diamond grindstone, each joining face was further ground to adjust surface roughness. The rolls were coaxially piled up, and diffusion bonding was performed thereto.

Figure 2:
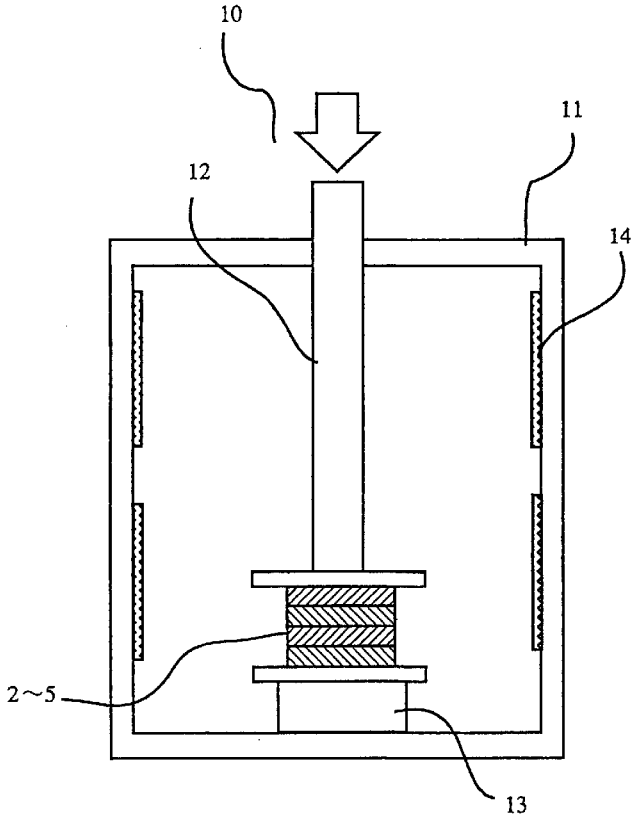
FIG. 2 is a schematic view of a diffusion bonding device of a composite roll for use in the example.

The diffusion bonding was carried out by using a diffusion bonding device 10 shown in FIG. 2. In FIG. 2, the diffusion bonding device 10 comprises a chamber 11, a pressure rod 12, a pressure pedestal 13 and a heater 14. In a joining step, the grooving rolls 2 to 5 are placed on the pressure pedestal 13 and are aligned. Subsequently, the chamber 11 is internally de-aerated to provide a non-oxidizing atmosphere. After the chamber is internally heated to predetermined temperature by the heater 14, the grooving rolls 2 to 5 are pressed with the pressure rod 12. In this state, pressing is maintained for a predetermined period. The joining condition thereof is as shown below:

Joining temperature: 950° C.

Pressure: 3.0 MPa

Pressure holding time: 4 hours

Figure 3:
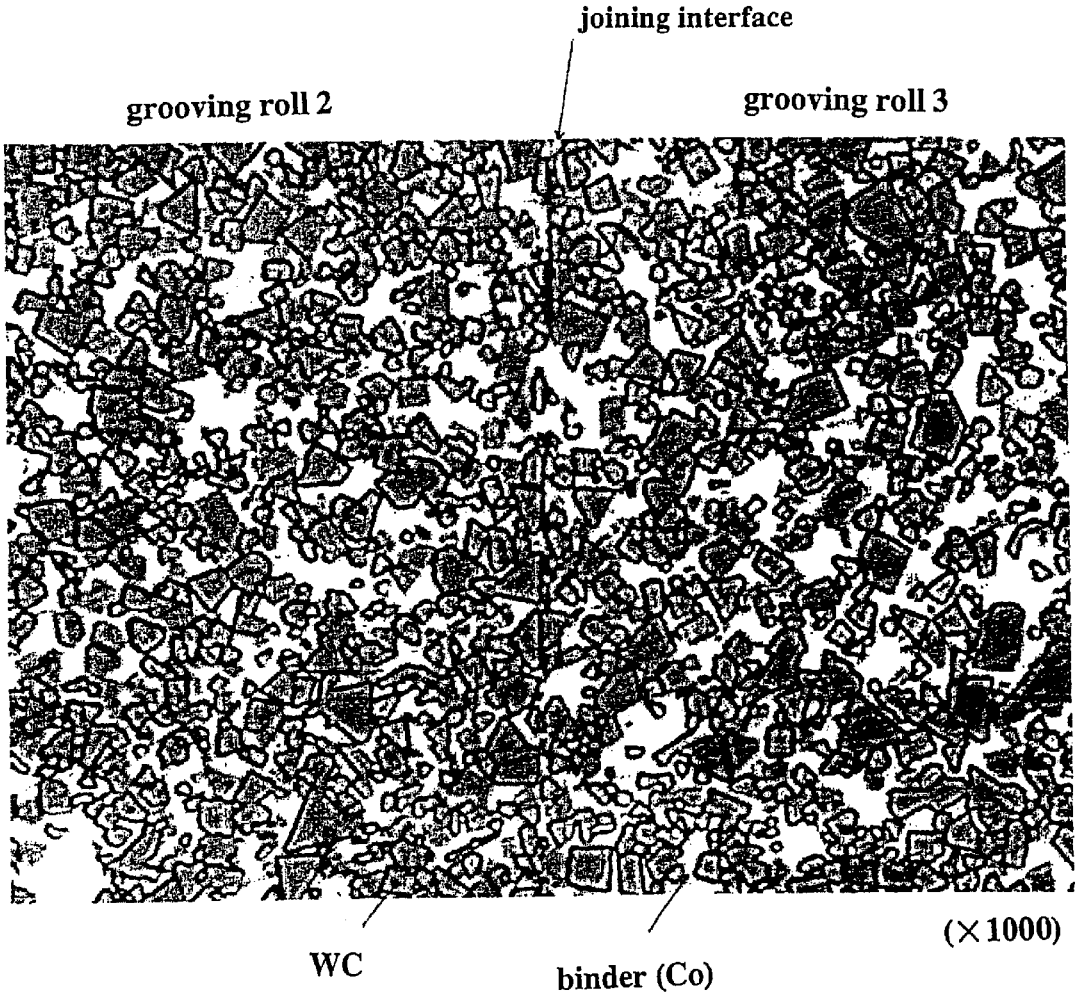
FIG. 3 is an enlarged photograph of a joining boundary microstructure of the composite roll manufactured in the example.

FIG. 3 is an enlarged photograph of a joining boundary microstructure when the grooving rolls are joined under the above-noted condition. In FIG. 3, although the grooving rolls joined by the above-noted method have a part that can be slightly recognized as a boundary, the boundary is hardly visible. Particularly, binder phases are nearly integrated with each other between two members, and it is found that the grooving rolls are physically almost in one body.

With the composite roll 1, grooves were formed on one face of a copper plate (33.0 mm wide, 0.3 mm thick). Accordingly, it was confirmed that the roll protrusions were not deformed until 20 tons of copper plates were processed.

SECOND EXAMPLE

In this example, a different material was used for the grooving rolls. A composite roll was manufactured by joining the grooving rolls made of tungsten carbide $Mo_2C$-nickel cemented carbide (WC-1.6% $Mo_2C$-20% Ni alloy, WC mean grain size of 2.5 $\mu$m: hardness HRA of 82.5), and the durability thereof was tested. The joining condition herein is the same as the condition in the first example.

Then, grooves were formed on the same copper plates as in the first example by using this composite roll, and it was confirmed that the roll protrusions were not deformed until 40 tons of copper plates were processed. This roll can process twice the amount of copper plates as the composite roll of the first example. It is considered that this difference is due to the improvement of corrosion resistance of the composite roll since nickel is used as a binder.

COMPARATIVE EXAMPLE

In order to confirm the durability of the composite rolls manufactured in the above-noted two examples, metallic strips were processed by using a composite roll that was manufactured by tightening conventional grooving rolls.

The composite roll in this comparative example is made of the same material as in the first example, and is made by combining the grooving rolls in which each grooving roll is different in groove shape, size and pitch, and by tightening them with bolts. In this case, a gap was hardly visually detected at joining faces at each grooving roll.

Grooves were formed on the same copper plates as in the first example with the composite roll combined with bolts. The deformation of grooves of copper plates was detected when two tons of copper plates were processed. In other words, it was confirmed that the durability of the composite roll in this comparative example is only one tenth that of the composite rolls relating to the present examples.

Accordingly, the composite roll relating to the present invention can efficiently form multiple types of grooves on metallic strips. Since the composite roll of the present invention particularly has excellent durability and can manufacture products of preferable quality over a long period with stability, the exchange frequency of composite rolls may be reduced contributing to the reduction of productions costs.

What is claimed is:

1. A composite roll for manufacturing heat transfer tubes, comprising:

at least two grooving rolls that have protrusions where at least one of cross sectional shapes, lead angles relative to a rotation direction and sizes is different, said at least two grooving rolls being combined to permit formation of multiple types of grooves on a surface of metallic strips when pressed against the metallic strips, said at least two grooving rolls being integrally joined by diffusion bonding.

2. The composite roll for manufacturing heat transfer tubes according to claim 1, wherein at least one of the at least two grooving rolls consists essentially of tungsten carbide-based cemented carbide, and the hardness thereof is about 81 to 90 in Rockwell A hardness.

3. The composite roll for manufacturing heat transfer tubes according to claim 1, wherein at least one of the at least two grooving rolls consists essentially of tungsten carbide-nickel cemented carbide, and the hardness thereof is about 81 to 90 in Rockwell A hardness.

* * * * *